United States Patent [19]

Fujii et al.

[11] Patent Number: 4,478,510

[45] Date of Patent: Oct. 23, 1984

[54] CLEANING DEVICE FOR MODULATION CONTROL MEANS

[75] Inventors: Haruo Fujii; Yujiro Ando, both of Yokohama, Japan

[73] Assignee: Canon Kabushiki Kaisha, Tokyo, Japan

[21] Appl. No.: 424,539

[22] Filed: Sep. 27, 1982

[30] Foreign Application Priority Data

Dec. 16, 1981 [JP] Japan ..... 56-203333
Jan. 14, 1982 [JP] Japan ..... 57-4308

[51] Int. Cl.[3] ..... G03G 21/00
[52] U.S. Cl. ..... 355/15; 355/3 SC
[58] Field of Search ..... 355/15, 3 SC, 3 R; 118/652

[56] References Cited

U.S. PATENT DOCUMENTS 3,689,935 9/1972 Pressman et al. ..... 346/74 ES
3,961,848 6/1976 Turner ..... 355/4
4,105,444 8/1978 Shinohara et al. ..... 355/3 SC
4,298,268 11/1981 Sato et al. ..... 355/15 X

FOREIGN PATENT DOCUMENTS 55-36851 3/1980 Japan ..... 355/3 SC

*Primary Examiner*—R. L. Moses
*Attorney, Agent, or Firm*—Fitzpatrick, Cella, Harper & Scinto

[57] ABSTRACT

This invention provides a cleaning device for an image forming apparatus in which an image is formed on an image receiving member by controlling the passage of charged particles such as charged toner particles or a flow of ions through control device having plural openings or slits, and provides in for such a control device. The cleaning device of the present invention eliminates the material deposited in the vicinity of the openings of the control device by means of discharge phenomenon or potential difference, thereby continuously cleaning the openings of the control device and thus enabling stable image formation.

16 Claims, 12 Drawing Figures

CLEANING DEVICE FOR MODULATION CONTROL MEANS

BACKGROUND OF THE INVENTION

1. Field of the Invention

The present invention relates to an image forming apparatus utilizing an electric field formed in an opening, particularly relates to controlling the passing of charged particles such as ions or developer particles, for example charged toner particles or charged ink droplets (hereinafter collectively called toner), through said opening, and more particularly relates to the cleaning of the means for controlling the passing of such charged particles.

2. Description of the Prior Art

A direct recording process for image formation on an image receiving member by modulation of toner is disclosed in the U.S. Pat. No. 3,689,935. Said process utilizes a toner control member composed of two electrodes positioned across an insulating layer and provided with linearly arranged openings, through which the charged toner particles are supplied under control from a toner supply source, thereby forming an image on a recording member placed across said toner control member. The above-mentioned process is, however, not adequate for practical use because of drawbacks such as the uneven toner supply leading to uneven image formation on the recording member, difficulty in high-speed recording and clogging of the openings of the control member with toner.

SUMMARY OF THE INVENTION

The object of the present invention is to provide an apparatus which overcomes the above-mentioned drawbacks by a stable supply of charged particles such as ions or toner particles to the control member, thus enabling stable image formation over a prolonged period.

The above-mentioned object can be achieved according to the present invention by an apparatus which comprises a control member for the charged particles, which control member includes an insulating member with openings for passing said charged particles and at least a pair of electrodes with corresponding openings positioned across said insulating member, and a counter electrode positioned at the side of an image receiving member for receiving the modulated flow of the charged particles. The present invention utilizes spark discharges or a potential difference in the vicinity of said openings of the control member for the purpose of eliminating dusts or toner particles deposited in said openings or ozone compounds generated in case corona ions from a corona discharge are utilized as the charged particles. Such spark discharge can be effectively caused between the paired electrodes across the insulating member, or between one of the paired electrodes and the source of charged particles or the counter electrode.

DETAILED DESCRIPTION OF THE PREFERRED EMBODIMENTS

Now the present invention will be explained in detail by embodiments thereof in which toner particles are employed as charged particles.

Figure 1A:
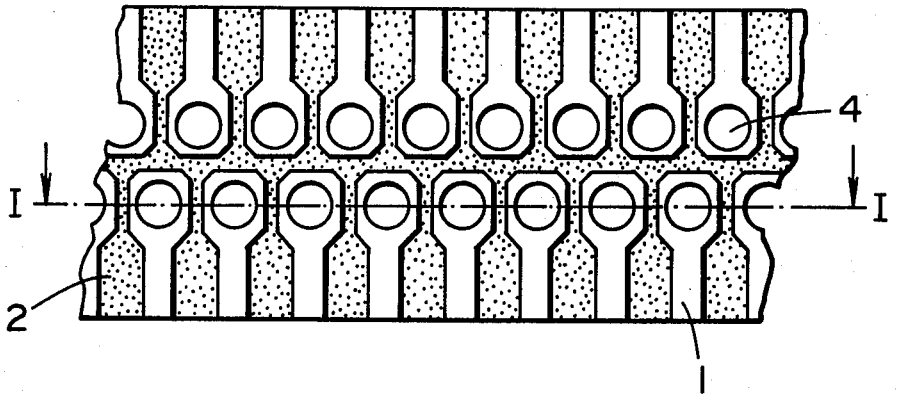
FIG. 1A is a plan view of an embodiment of the control means usable in the apparatus of the present invention.
Figure 1B:
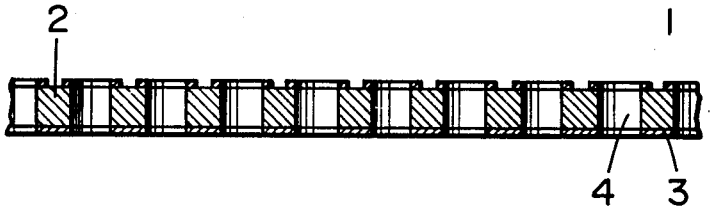
FIG. 1B is a cross-sectional view along a line I—I in FIG. 1A.
Figure 2:
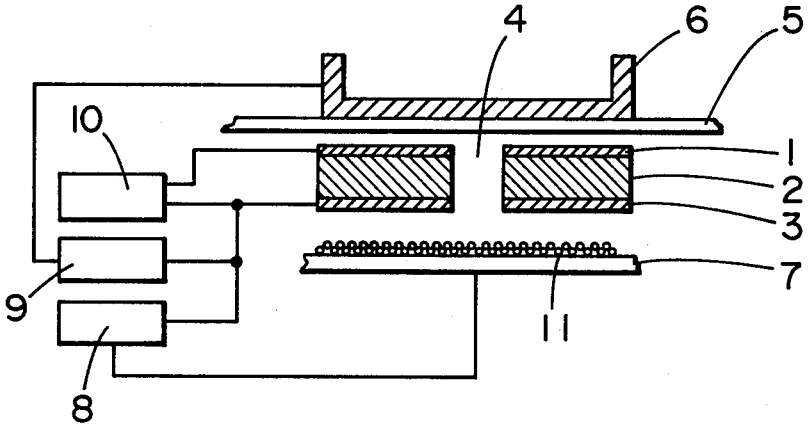
FIG. 2 is a schematic view showing the principle of toner modulation by the control member shown in FIG. 1A.
Figure 3:
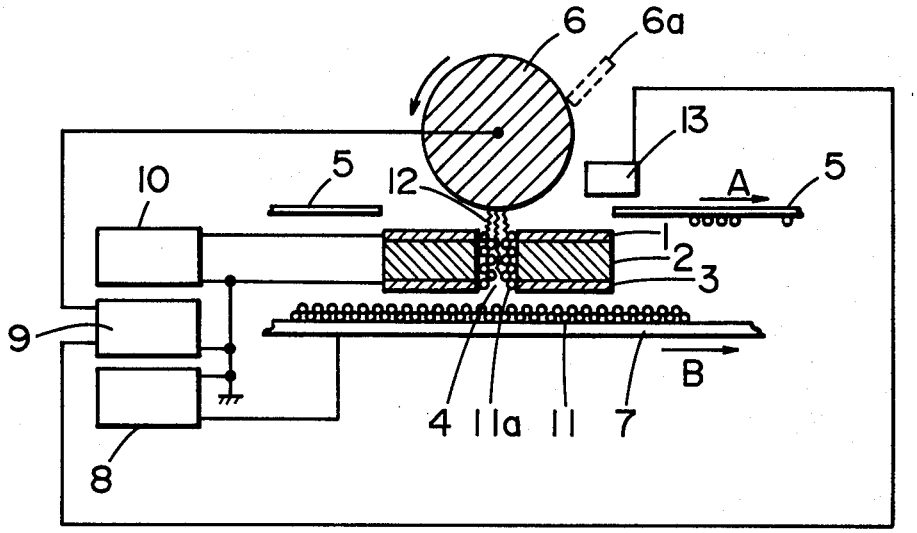
FIG. 3 is a cross-sectional view of an image forming apparatus embodying the present invention.

FIG. 1A is a plan view of a control member in which the present invention is applicable, FIG. 1B is a cross-sectional view along a line I—I in FIG. 1A, FIG. 2 is a schematic view showing the principle of modulation of charged particles by said control member, and FIG. 3 is a schematic view showing the principle of the present invention.

FIGS. 1A and 1B show an embodiment of the control member in which there is shown signal electrodes 1 capable of individually receiving voltages, base electrodes 3 grounded or supplied with a determined potential and connected over all or plural openings, an insulating member 2 for insulating the signal electrodes 1 from the base electrodes 3, and openings 4 penetrating through said signal electrodes 1, base electrodes 3 and insulating member 2 with a same area, wherein said electrodes 1 and 3 constitute paired electrodes. Said base electrodes 3 may also be positioned at the side of the image receiving member.

Referring to FIG. 2 which shows the principle of the toner modulation by the above-described control member, there is shown a counter electrode 6 positioned in facing ralationship to the control member; a recording member 5 constituting an image-receiving member maintained in close contact with said counter electrode 6 when subjected to toner modulation; a toner conveyor 7 of a non-magnetic conductive material; and one-component insulating magnetic toner 11 uniformly coated on said toner conveyor 7. The control member explained in FIGS. 1A and 1B is positioned between the counter electrode 6 and the toner conveyor 7. The counter electrode 6 is positioned in facing relationship to the signal electrode 1, and the toner conveyor 7 is positioned in facing relationship to the base electrode. An AC power source 8 is connected to the base electrode. A DC power source 9 is connected to the counter electrode 6 and to the base electrode 3, and a signal source 10 is connected to the signal electrode 1 and to the base electrode 3.

In the above-described structure, the base electrode 3 is usually grounded electrically while the toner conveyor 7 receives an AC voltage or a DC-biased AC voltage from the AC power source 8, whereby the toner 11 on the toner conveyor 7 jumps around between the base electrode 3 and the toner conveyor 7 due to an AC electric field generated therebetween. If a voltage is applied across the signal electrode 1 and the base electrode 3 by the signal source 10 in this state in a direction for passing the toner, said jumping toner 11 passes through the opening 4 and is attracted by the signal electrode 1. Since a DC voltage is applied across the counter electrode 6 and the base electrode 3 by the DC power source 9, the toner 11 is further accelerated and deposited on the recording member 5.

In the absence of the signal voltage supplied from the signal source 10 to the signal electrode 1 and the base electrode 3, or in the presence of an inverse electric field in the opening, the jumping toner does not pass through the opening 4. Under the influence of an electric field generated by the AC voltage across the base electrode 3 and the toner conveyor 7, the toner performs reciprocating movement, causing sliding contact with the control member and thus cleaning said member. A toner image is thus formed on the recording member in the aforementioned manner by the image-wise signal application to the signal electrodes 1, and is subsequently fixed on said recording member by heat or by pressure. In case corona ions are utilized as the charged particles, a corona discharger is employed in place of the toner conveyor 7 shown in FIG. 2.

In the control member of the above-described structure, the opening 4 may be clogged by toner or dusts in the air during use and may therefore become unable to control the passage or toner particles.

FIG. 3 shows an embodiment of the present invention wherein same or equivalent components as those in FIG. 1 or FIG. 2 are represented by same numbers. A recording member detector 13 for identifying the recording and non-recording periods is composed for example of a microswitch, an untrasonic detector, or a combination of a photosensor and a light source and is utilized for controlling the DC power source 9. In the present embodiment said switch 13 causes a spark discharge for a determined period after the passing of the rear end of the recording member. Otherwise said switch 13 is placed upstream to the recording position and causes the spark discharge for a determined period after said switch is closed. The spark discharge 12 is generated in the vicinity of the opening 4 between a roller-shaped counter electrode 6 and the signal electrode 1 or the base electrode 3. In the apparatus shown in FIG. 3, the toner modulation with the recording member 5 moving in a direction of arrow A and with the toner conveyor 7 moving in a direction of arrow B results in the clogging of the opening with toner or the like as explained above. For this reason the image recording cannot be continued over a prolonged period.

The present invention therefore provides a method of removing for example the toner 11*a* deposited in the opening 4. A detector 14 detects the presence or absence of the recording member 5, and, in its absence, the DC power source 9 supplies the counter electrode 6 with a voltage higher than that in the recording operation to generate a spark discharge between the counter electrode 6 and the base electrode 3 or signal electrode 1, whereby said spark discharge cleans the opening 4 by filliping away the toner 11*a* deposited therein. A cleaning blade 6*a* may be provided for cleaning the counter electrode 6 if necessary.

Figure 4:
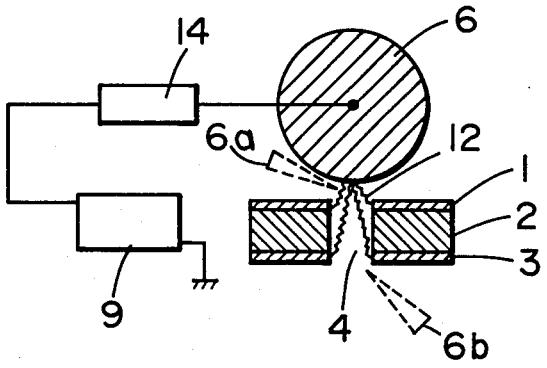
FIGS. 4 and 5 are cross-sectional views showing other embodiments of the present invention.

The potential difference between the counter electrode 6 and the base electrode 3 can be in the order of 500 volts for a distance of 500 microns at the image recording. In the cleaning operation the DC power source 9 supplies a voltage of about 1500 volts between the counter electrode 6 and the grounded base electrode, thereby generating a spark discharge therebetween. During said spark discharge for cleaning, the signal electrode 1 is preferably grounded for protecting the signal source 10. Also for the purpose of protecting the signal source 10, a protecting resistor of ca. 15MΩ is preferably inserted between the counter electrode and the DC power source as shown in FIG. 4 in order to suppress the spark discharge current in the order of several hundred microamperes or even less.

As explained in the foregoing, the present invention in an embodiment thereof, prevents clogging of the opening 4 of the control member with toner and removes the toner deposited in the opening of the base electrode 3 facing the toner conveyor 7, simply by elevating the output voltage of the DC power source 9 in the absence of the recording member 5 thereby generating a spark discharge between the counter electrode 6 and the signal electrode 1 or base electrode 3. It is therefore rendered possible to conduct the image formation in a stable manner over a prolonged period, without the replacement of the clogged control member or the cleaning of the opening 4 with a fine needle as was needed in the conventional apparatus.

Figure 5:
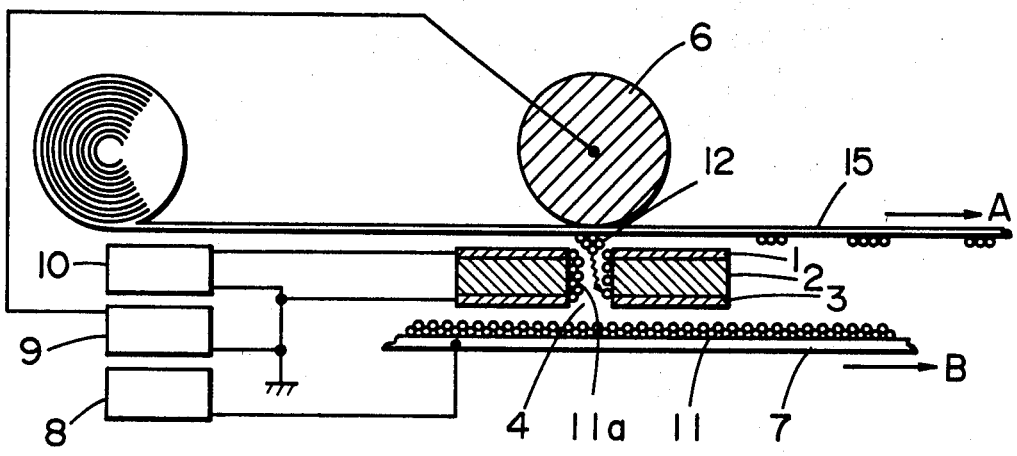

FIG. 5 shows another embodiment of the present invention in which the principle of toner modulation is same as explained before but a rolled sheet 15 is employed as the recording member instead of a cut sheet. In this case the signal source 10 controls the DC power source 9 in such a manner that a voltage necessary for image recording is applied between the base electrode 3 and the counter electrode 6 in the presence of a signal voltage for recording but a high voltage sufficient for causing a spark discharge as explained in relation to FIG. 3 is applied in the absence of such signal voltage. In the present embodiment the toner 11*a* accumulated in the opening 4 is transferred onto the recording member 5, thus forming a linear broken line thereon, which can be utilized as a guide line for tearing off the recording sheet.

As explained in the foregoing, a spark discharge is generated between the counter electrode and the base electrode or signal electrode to remove the toner particles and dusts deposited in the opening, thereby constantly cleaning said opening. It is also possible to replace the counter electrode in the foregoing explanation by other electrodes such as another external electrode such as a flat electrode or a needle-shaped electrode as represented by 6*a*, 6*b* in FIG. 4.

Although the foregoing embodiments depends on a spark discharge generated between the counter electrode 6 and the base electrode 3 or signal electrode 1, a similar effect as explained in relation to FIG. 3 or 5 can also be obtained by applying a sufficient voltage between the base electrode 3 or signal electrode 1 and the toner conveyor 7 constituting the charged particle source to cause a spark discharge therebetween. In such a case, however, if the apparatus uses the toner as the charged particles in a recycled manner, the toner 11*a* deposited in the opening 4 is returned to the toner conveyor, so that certain properties, such as charge polarity, of the toner may deteriorate by prolonged use. For this reason the material of the toner has to be cautiously selected.

As a variation to the foregoing it is also possible to generate a spark discharge by a potential difference between the base electrode and the signal electrode, preferably in combination with a potential difference given to the counter electrode or the charged particle source for attracting the toner 11*a*, or to generate a spark discharge between either one of the base electrode and signal electrode and either one of the counter electrode or charged particle source. Furthermore the present invention is effective for the elimination of a solidified liquid ink, or of compounds formed from ozone in case a corona discharge is used as the charged particle source. Also if the control member is provided with other electrodes, such other electrodes may naturally be utilized for generating the spark discharge.

The mechanism of filliping off of the particles from the opening can be explained as follows, although it is not yet fully understood. As explained in FIG. 3, the spark discharge between the counter electrode 6 and the base electrode 3 or signal electrode 1 exerts, by the energy of said discharge, a peeling effect on the toner 11*a* from the wall of the opening 4, and the toner thus peeled off is attracted toward the counter electrode 6 by a strong electric field exerted by said electrode, and thereby removed from the opening 4.

In an experiment the control element was composed of a polyimide insulating member of 50μ, on both faces of which were provided a signal electrode and a base electrode both composed of copper of 20μ in thickness. The counter electrode was positioned in facing relationship to the signal electrode with a distance of 0.5 mm therebetween, and the toner conveyor was positioned at a distance of 0.3 mm from the base electrode. The potential of the signal electrode to the base electrode was maintained at 100 V at the toner modulating operation, or at −150 V when the modulation was interrupted. A potential difference of 500 V was maintained between the signal electrode and the counter electrode, and an AC voltage of 600 V in effective value was applied between the toner conveyor and the base electrode.

In the above-described experiment, a voltage of 2500 V was applied between the counter electrode and the signal electrode and/or base electrode for causing a spark discharge therebetween in order to achieve the cleaning effect of the present invention. On the other hand a potential difference of 1400 V was needed to generate a spark discharge between the toner conveyor and the base electrode and/or signal electrode. Also a potential difference of 1200 V was needed to generate a spark discharge between the signal electrode and the base electrode.

In the case of generating the spark discharge only between the signal electrode and the base electrode under the above-mentioned condition, a voltage in the order of 500 to 800 V is preferably applied to the counter electrode or to the toner conveyor in order to displace thereon the removed toner.

As explained in the foregoing, the present invention allows to fillip off the toner or foreign substances inside or in the vicinity of the openings of the control member by the energy of discharge by simply generating a spark discharge inside or in the vicinity of said openings, thereby eliminating the need for replacement of the control member or cleaning thereof normally needed because of the clogging of the openings to enable stable image recording over a prolonged period.

In the foregoing embodiments the cleaning of the openings of the control member is achieved by a spark discharge, but a certain cleaning effect is also attained even by a potential difference not sufficient for causing such spark discharge.

The following is an explanation of an embodiment which utilizes such a potential difference for cleaning.

Figure 6:
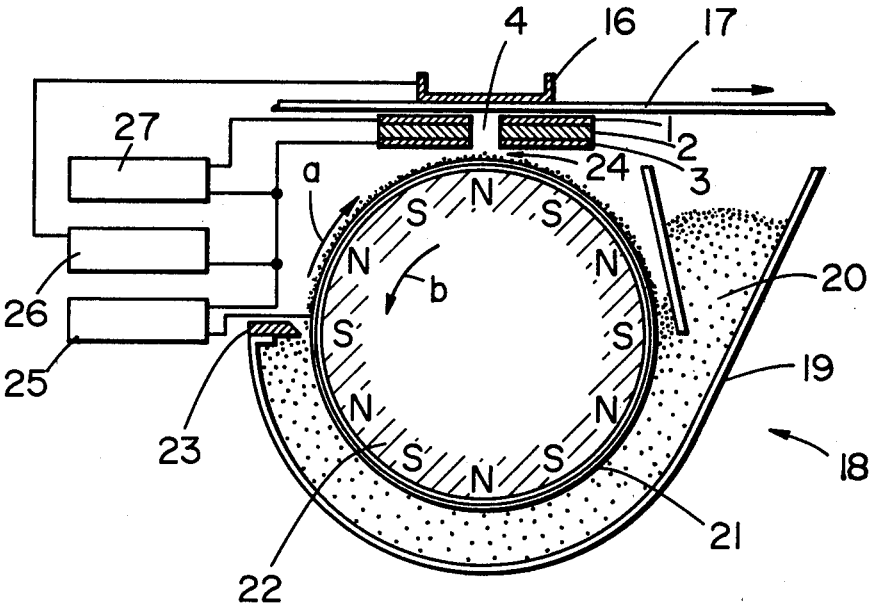
FIG. 6 is a cross-sectional view of an embodiment of the present invention.

FIG. 6 shows an embodiment of the present invention in a cross-sectional view, wherein the control member is same as that explained in relation to FIG. 1.

In FIG. 6 there is shown a signal electrode 1 for receiving image signal voltage; an insulating member 2 for electrically insulating said signal electrode from a base electrode; an opening 4 provided in said control member for passing the toner; a counter electrode 16; a recording member 17 constituting the image receiving member and displaced in a direction of the arrow shown and in close contact with said counter electrode; and toner conveying unit 18 in which one-component insulating magnetic toner 20 held in a toner container 19 is transported by a toner conveyor 21 consisting of a non-magnetic cylinder and rotated in a direction of arrow. Inside said conveyor 21 there is provided a fixed magnet 22 with alternately magnetized surfacial poles, whereby the toner 20 is uniformly spread on the surface of said conveyor 21 by the function of a blade 23 and of said magnet 22 upon rotation of the conveyor 21 in a direction of arrow a.

The toner arriving at a recording position 24 performs reciprocating motion between the base electrode and the toner conveyor 21 under the influence of an electric field caused by an AC voltage applied therebetween. A signal source 26 is connected to the signal electrode 1 and the base electrode 3, and a DC power source 27 supplied a DC voltage to the base electrode 3 and to the counter electrode 16. In response to an image signal applied to the signal electrode 1 during said reciprocating motion, the toner present in an opening corresponding to said signal electrode passes the opening 4, and is accelerated by the DC voltage supplied from the DC power source 27 to the base electrode 3 and the counter electrode 16, thus reaching the recording member 17 and forming an image thereon.

The above-described embodiment experimented with an apparatus in which the distance between the counter electrode 16 and the signal electrode 1 is adjustable within a range from ca. 100μ to 10 mm. In the present embodiment said distance was selected as ca. 500μ, and a DC voltage of 700 V was applied between the counter electrode and the base electrode by the DC power source 26. The AC power source 25 applied an AC voltage of 1.4 KV and 4.5 KHz between the base electrode and the toner conveyor, which were mutually spaced by a distance of 600μ. Naturally the above-mentioned voltages and frequency were determined in relation to the spacings and the linear speed of the recording member.

The signal electrode was spaced by 25μ from the base electrode by the insulating member, and was selectively supplied with pulse voltages of 120 V necessary for image formation.

In the above-mentioned conditions, the signal electrode and the counter electrode 16 were maintained positively charged with respective to the base electrode 3 when the toner was negatively charged, and vice versa. The openings 4 of the control member had a diameter of 150μ, and the toner had an average particle size of 13μ.

In case the recording member 17 was displaced in the direction of arrow with a linear speed of 40 cm/sec. for image recording, the toner introduced into the openings was retained therein in the absence of signal voltage for recording and eventually deposited on the wall of the openings and on the base and signal electrodes. Also the toner particles having a little amount of charge may similarly deposit on the signal electrodes and on the wall of the openings. Such phenomenon leads to the accumulation of toner in the openings and to the smearing of the signal electrodes, eventually resulting in the clogging of the openings and in a weakened electric field of the signal electrodes, thus disabling the image recording operation.

Figure 7A:
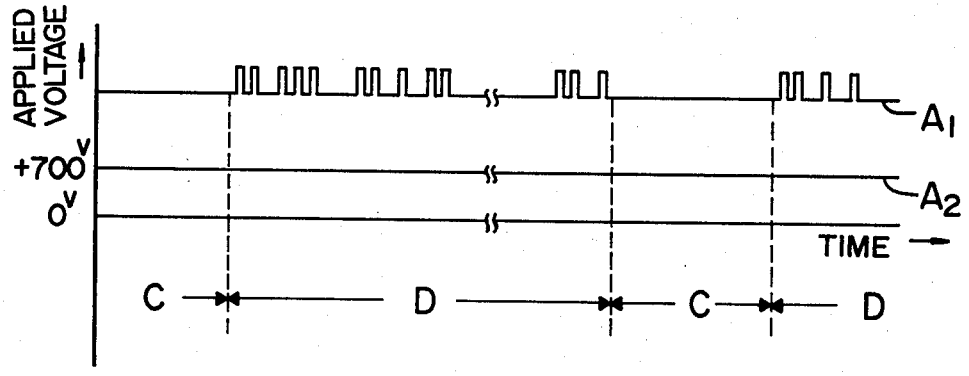
FIGS. 7A and 7B are waveform charts showing applied voltages.
Figure 7B:
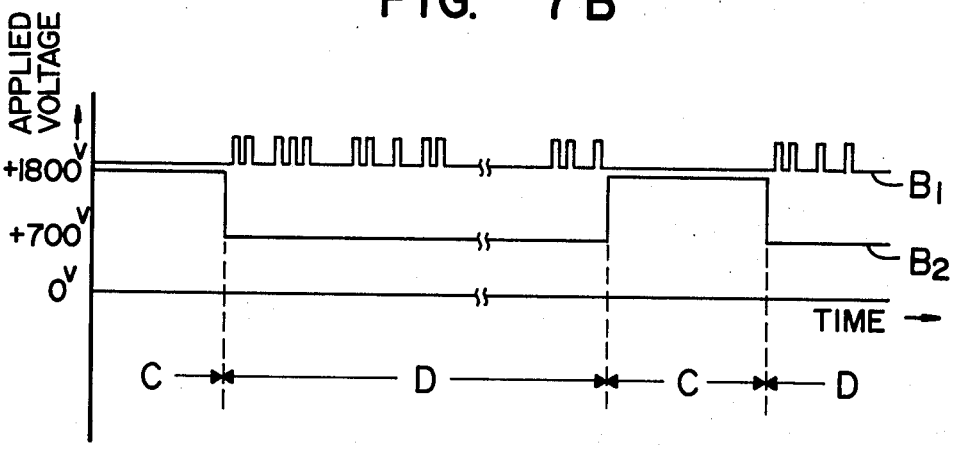

The above-mentioned drawback can, however be resolved by an embodiment of the present invention which will be explained in relation to FIGS. 7A and 7B showing the waveforms supplied to the apparatus shown in FIG. 6.

FIG. 7A shows the waveform A1, A2 supplied from the signal source 27 and the DC power source 26, respectively, when the present invention is not applied, while FIG. 7B shows the corresponding waveforms B1, B2 when the present invention is applied. C and D indicate a period without image recording and a period for image recording, respectively.

The above-mentioned drawback can be resolved by applying a high voltage to the recording member for attracting the toner during the non-recording period as shown in FIG. 7B, thereby removing the toner remaining in the openings. Such high voltage cannot be supplied continuously since it becomes impossible to form a control electric field in the openings by the supply of signal voltages to the signal electrodes.

The toner attraction toward the recording member can be further enhanced by interrupting the voltage supply from the AC power source 25 or by interrupting the supply of toner by stopping the toner conveyor 16 during the non-imaging period C. In this manner a sufficient cleaning is achieved and a stable image formation over a prolonged period is rendered possible.

In the embodiment shown in FIG. 6, the toner removed from the openings may be received by the recording member or may be once received by the counter electrode and then carried away by the rear face of the recording member. Such selection is possible since the amount of the toner remaining in the openings is in fact quite small.

Figure 8:
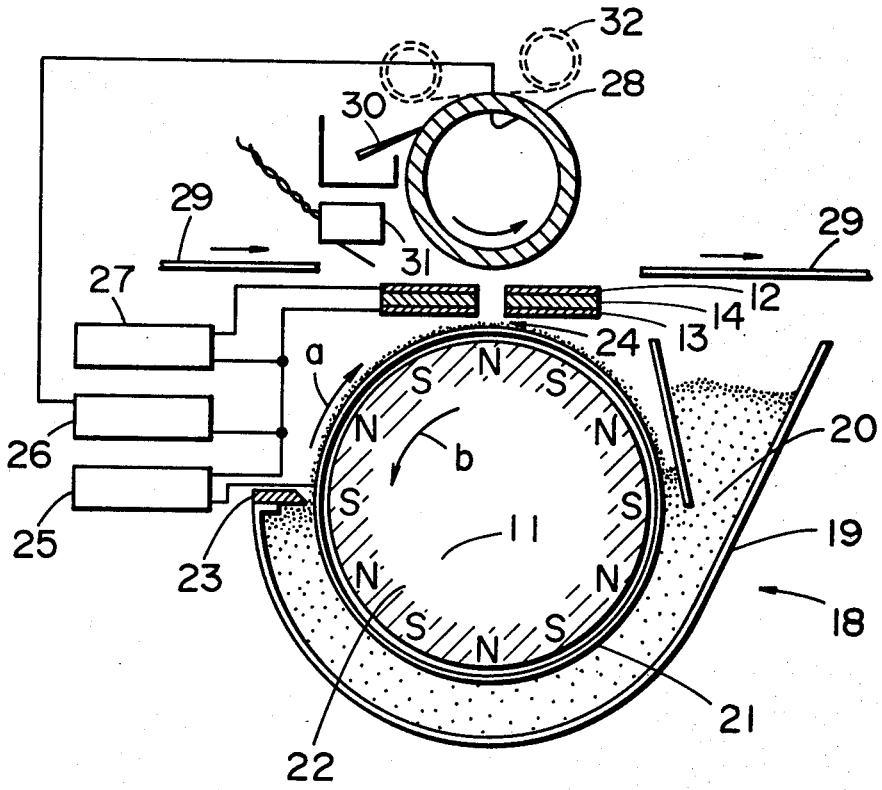
FIG. 8 is a cross-sectional view showing another embodiment of the present invention.

FIG. 8 is a cross-sectional veiw showing another embodiment for removing the toner in the openings 4 by a potential difference, in which a roller-shaped counter electrode 28 in combination with a cleaning member is utilized in place of the plate-shaped counter electrode shown in FIG. 6. The arrangement explained above facilitates the use of cut sheets, and prevents the smearing of the recording member by the toner removed from the openings. In FIG. 8 the same components as those in FIG. 6 are represented by same numbers.

In the present embodiment a roller-shaped counter electrode 28 can be provided with a surfacial insulating layer for charging or with an air suction function in order to attract the recording member, and is rotated in a direction and at a peripheral speed same as the advancing direction and speed of the recording member 29 of cut-sheet form. A cleaning blade 30 is maintained in contact with the periphery of said electrode 28. A microswitch 31 for detecting the presence of the recording member is provided for controlling the DC power source 26, AC power source 25 and an unrepresented drive system for the conveyor 21.

In the present embodiment a switch is utilized for identifying the recording period from the non-recording period. The microswitch 31 detects the leading end of the recording member and causes the DC power source 27 to supply a voltage of +700 V to the counter electrode 28 while said recording member passes the modulating position. During the absence of the recording member at the modulating position, a voltage of +1800 V is supplied to the counter electrode 28. Also during the absence of the recording member, the AC bias voltage between the control member and the toner conveyor may be interrupted since the supply of toner to the control member is unnecessary.

During the cleaning step of the control member in the absence of the recording member at the modulating position, the counter electrode 28 is smeared by the toner removed from the control member but is cleaned by the cleaning blade 30 for scraping off the toner from the periphery of said electrode 28. In this manner the smearing of the recording member can be prevented, and a stable image recording without smearing can be ensured over a prolonged period.

The cleaning blade employed for removing the toner from the electrode 28 in the foregoing embodiment can be replaced by web means 32 such as paper or textile, or by other suitable means. Also the microswitch utilized for detecting the recording member may be replaced by a photoelectric sensor or an ultrasonic sensor.

In the foregoing embodiment a constant DC voltage is applied between the control member and the image receiving member, but it is naturally possible to apply an AC voltage instead. In such a case the direction of the electric field between the toner supply source and the image receiving member has to be the same as that of the electric field between said image receiving member and the control member. In an apparatus utilizing such electric fields, the AC voltage supplied to the image receiving member may be biased in a polarity for attracting the toner, only during the non-recording period. It is also effective for eliminating the charged particles in the openings to generate, during the non-recording period, an electric field in said openings for directing the charged particles toward the image receiving member by means of a voltage supply from the signal source, and to interrupt simultaneously the voltage application between the charged particle supply source and the control member.

Also in case the charged particles are toner, the use of magnetic toner in combination with transportation under a magnetic field as shown in FIGS. 6 and 8 provides the advantages of ease in forming a thin toner layer and preventing of toner scattering. However the toner need not necessarily be magnetic if the toner is carried by a fine charge pattern formed on an insulator or by a brush having a depth of 1 to 3 mm. Such toner conveyor utilizing magnetic field or brush may be employed also in the apparatus shown in FIG. 3. Also as a variation to the toner conveyor shown in FIG. 6, the magnet 22 may be rotated in a direction of arrow b in combination with a fixed cylindrical conveyor.

Figure 9:
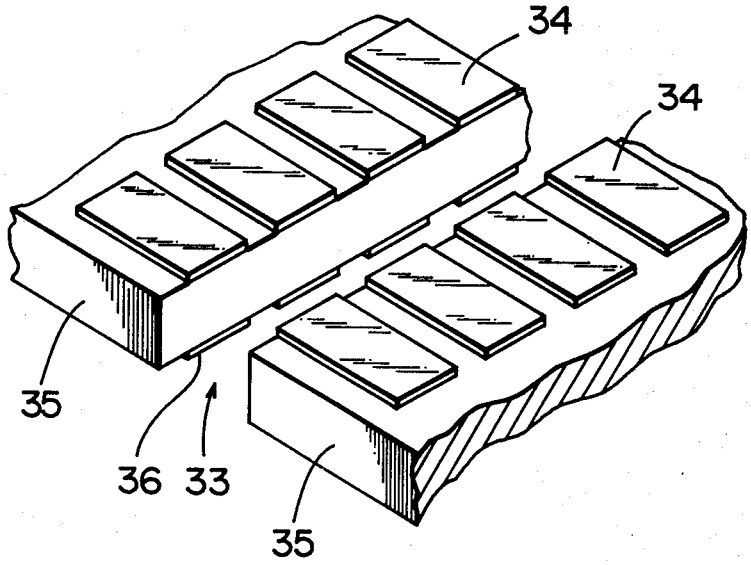
FIG. 9 is a perspective view showing another embodiment of the control means.

The present invention is applicable not only to the control member having independent plural openings as shown in FIG. 1 but also to a control member having a slit-formed opening as shown by a perspective view in FIG. 9, in which illustrated are a slit opening 33, signal electrodes 34, an insulating member 35 and base electrodes 36. In this manner the present invention is effectively applicable to any control member for forming an image by means of charged particles such as charged toner particles or ions, and is not limited by the practical structure of said control member.

Figure 10:
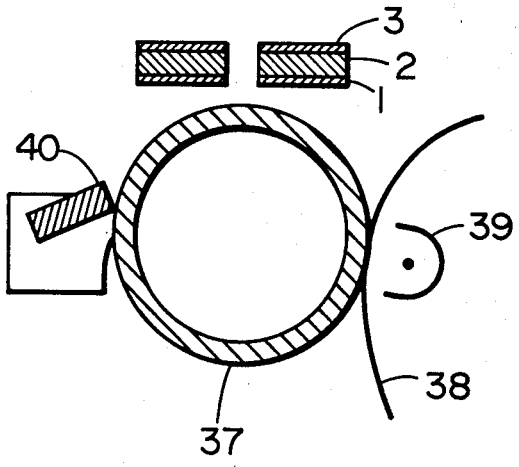
FIG. 10 is a cross-sectional view showing another embodiment of the image receiving member.

The image formation on the image receiving member is not only limited to the direct fixation of the image formed on a sheet-form recording member as explained in the foregoing but also is achievable, as shown in FIG. 10, by forming a toner image on an insulating drum 37 constituting an image receiving member and transferring said toner image onto another recording sheet 38 by means of an electric field of a corona discharge from a discharger 39, wherein the surface of said drum 37 is cleaned thereafter by a cleaning blade 40. In this manner the present invention is not limited by the mode of image formation on the image receiving member.

As explained in the foregoing, the present invention permits for the maintenance of the control member without detaching the same from the apparatus, and ensures stable image formation by conducting the cleaning process at every non-imaging period. Also the present invention provides an advantage of extending the service life of the control member as the cleaning can be effected without mechanical contact.

In the foregoing the present invention has been explained by embodiments thereof utilizing a spark discharge or utilizing a potential difference. It is also possible in practice to combine a method of generating a spark discharge for example by an electrode *6a* or *6b* shown in FIG. 4 simultaneously with a method for supplying the counter electrode with a voltage higher than the voltage during the recording period and opposite in polarity to that of said discharge, thereby electrostatically attracting the charged particles and dusts, fillipped away by said discharge, from the control member in a more efficient manner.

What is claimed is:

1. An apparatus for controlling a flow of charged particles, comprising:

a source for generating charged particles;

a control member having means for defining an opening, said control member controlling the passage of charged particles from said charged particle source by an electric field formed in said opening; and a power source for generating a spark discharge from an electrode constituting a part of said means for defining said opening of said control member to clean said opening.

2. An apparatus according to claim 1, wherein said control member includes an insulating member having an opening and paired electrodes positioned across said insulating member so as not to close said opening, and wherein said spark discharge is generated between said paired electrodes.

3. An apparatus according to claim 1 or 2, wherein said spark discharge is generated between an electrode of the control member and a conductive member positioned in the vicinity of said electrode.

4. An apparatus according to claim 3, wherein said conductive member is a counter electrode for directing the controlled charged particles toward an image receiving member.

5. An apparatus according to claim 3, wherein said conductive member in the vicinity of the electrode of the control member includes cleaning means.

6. An apparatus according to claim 3, wherein said conductive member is an electrode member positioned at the side of an image-receiving member for receiving the controlled charged particles.

7. An apparatus according to claim 3, wherein said conductive member is the source for generating charged particles.

8. An apparatus according to claim 7, wherein said source is a toner supporting member.

9. An apparatus according to claim 7, wherein said source is corona discharge means.

10. An apparatus according to claim 1 or 2, wherein said spark discharge of said control member is simultaneously generated between an electrode of said control member and plural conductive members in the vicinity thereof.

11. An apparatus for controlling a flow of charged particles, comprising:

a source for generating charged particles;

a control member having means for defining an opening, said control member controlling the passage of charged particles from said charged particle source by an electric field formed in said opening;

a first conductive member for generating a spark discharge from an electrode constituting a part of said means for defining said opening of said control member to clean said opening;

a second conductive member adapted for receiving a bias voltage during said spark discharge to electrostatically attract the deposit eliminated from said opening by said spark discharge; and a power source for causing said spark discharge.

12. An apparatus according to claim 11, wherein said first conductive member is an electrode provided at said opening, and wherein said second conductive member is a counter electrode for directing the controlled charged particles toward an image receiving member.

13. An apparatus according to claim 12, wherein said counter electrode is supplied with a voltage higher during said spark discharge than during image formation.

14. An apparatus for controlling a flow of charged particles, comprising:

a source for generating charged particles;

a control member having means for defining an opening, said control member controlling the passage of charged particles for said charged particle source by an electric field formed by a bias voltage supplied to an electrode constituting a part of said means for defining said opening;

said control member; and power source means for forming a higher potential difference between said conductive member and the electrode of said control member at the non-image formation side of said control member than at the image formation side of said control member to eliminate the substance deposited in said opening of said control member.

15. An apparatus according to claim 14, wherein the conductive member positioned in the vicinity of the control member is a counter electrode for directing the charged particles toward an image receiving member.

16. An image forming apparatus according to claim 14, further comprising means for cleaning the surface of said conductive member positioned in the vicinity of said control member.

* * * * *

UNITED STATES PATENT AND TRADEMARK OFFICE

CERTIFICATE OF CORRECTION

PATENT NO. : 4,478,510

DATED : October 23, 1984

INVENTOR(S) : HARUO FUJII, ET AL.

It is certified that error appears in the above-identified patent and that said Letters Patent is hereby corrected as shown below:

Column 7, line 44, "veiw" should read --view--.

Column 10, line 49, Claim 14, before "said control member; and" insert --a conductive member positioned in the vicinity of--;

line 61, Claim 16, after "An" delete "image forming".

Signed and Sealed this

*Fifteenth* Day of *October 1985*

[SEAL]

*Attest:*

*Attesting Officer*

DONALD J. QUIGG

*Commissioner of Patents and Trademarks—Designate*